United States Patent [19]

Schmolke

[11] Patent Number: 4,903,385

[45] Date of Patent: Feb. 27, 1990

[54] METHOD FOR MAKING CARD ROLLER RINGS

[76] Inventor: Karl-Heinz Schmolke, Amselweg 15, Neuweiler 5, Fed. Rep. of Germany, 7266

[21] Appl. No.: 300,517

[22] Filed: Jan. 23, 1989

[30] Foreign Application Priority Data

Feb. 19, 1988 [DE] Fed. Rep. of Germany ..... 3805281

[51] Int. Cl.[4] ..... B21D 53/12; B21H 1/14; B21K 1/02; B21K 1/04

[52] U.S. Cl. ..... 29/895.211; 29/127; 29/411; 29/418; 29/445; 19/101; 140/97

[58] Field of Search ..... 29/148.4 D, 411, 423, 29/127, 416, 418, 445; 140/97; 19/100, 101, 99

[56] References Cited

U.S. PATENT DOCUMENTS

| | | | |
|---|---|---|---|
| 265,901 | 10/1882 | Whitworth | 19/100 |
| 441,355 | 11/1890 | Cary | 29/411 |
| 3,030,698 | 4/1962 | Pissarevsky | 29/411 X |
| 3,081,499 | 3/1963 | Goldman | 19/99 |
| 3,740,809 | 6/1973 | Wolstencroft | 29/148.4 D |
| 3,858,277 | 1/1975 | Brown et al. | 19/99 |

*Primary Examiner*—Charlie T. Moon

[57] ABSTRACT

A method for making card roller rings for open-end spinning machines provides that a sawtooth wire (3) is wound onto a tube (1) of multiple ring length (a) and that the teeth (7) of the sawtooth wire (3) are removed at spacings corresponding to the ring length (a) to form a respective circumferential plunge-cut groove (9) extending down to the foot portion (8) of the sawtooth wire (3). Subsequently the sawtooth wire windings (12, 13) within the plunge-cut grooves are secured to the tube (1), whereupon the tube (1) with the sawtooth wire wound thereon is separated into individual card roller rings (2) substantially along the center of the plunge-cut grooves (9).

8 Claims, 3 Drawing Sheets

METHOD FOR MAKING CARD ROLLER RINGS

DESCRIPTION

Figure 1:
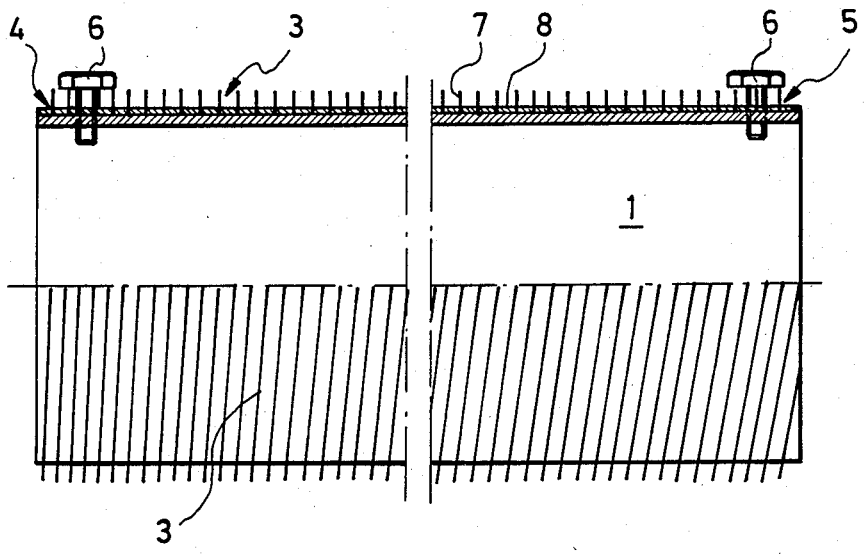

The invention relates to a method for making card roller rings, particularly for open-end spinning machines.

It is generally known to manufacture card roller rings by winding a sawtooth wire onto a tube section already having the length of the card roller ring, and securing the leading and trailing ends of the wire to the tube section. This manufacturing method is unable to comply with the increasing requirements regarding the true-running properties of card rollers.

In order to achieve the required true-running properties card roller rings including the card cloth are frequently cut from solid material in a milling operation, which is a laborious and expensive procedure.

It is therefore an object of the invention to provide a method of the type defined in the introduction, which permits card roller rings to be manufactured in a simple and cost-effective process while ensuring the required true-running properties.

This object is attained according to the invention by winding the sawtooth wire onto a tube of extended length, it is ensured that the foot portions of the sawtooth wire windings are uniformly supported on the tube. The leading and trailing ends of the sawtooth wire may be secured to the tube as by means of screws. When the teeth are subsequently removed at suitable spacings within the circumferential plunge-cut grooves, and the sawtooth wire is secured to the tube within these plunge-cut grooves, it is not the leading and trailing ends of the initially wound sawtooth wire which are thus secured, but rather intermediate sections of the wound sawtooth wire. As a result there are practically no longer any irregularities with respect to the height of the tips of the teeth of the sawtooth wire. When the tube is subsequently separated into individual card roller rings at the location of the plunge-cut grooves, the leading and trailing ends of the sawtooth wire section wound onto each card roller ring will again be secured thereto. In this regard it is of importance, however, that the leading and trailing ends of the shorter sawtooth wire sections are not coincident with the leading and trailing ends of the longer sawtooth wire wound onto the full length of the tube. In addition to the excellent accuracy of the card roller rings manufactured in this manner, the manufacture of the rings is highly economical inasmuch as it does not require each card roller ring to be separately wound.

According to another advantageous aspect the invention provides that the tube with the sawtooth wire wound thereon is subjected to a plasma-coating treatment prior to being separated into individual card roller rings. This results in the advantage that each card roller ring is completely coated without having to be subjected to an individual plasma-coating treatment.

According to a further characteristic of the invention, the sawtooth wire may be secured to the tube within the plunge-cut grooves by an electron-beam welding operation.

In accordance with still another characteristic of the invention, a particularly durable securing of the sawtooth wire may be achieved by guiding the electron-beam about the tube in a zig-zag pattern on the bottom of the respective plunge-cut grooves. In this manner even sawtooth wires having a narrow foot portion can be reliably and durably secured to the tube.

Although the plunge-cut grooves could also be formed by a milling operation it is preferred, according to a still further characteristic of the invention, that the teeth within the plunge-cut groove are ground down by means of a plunge-cut grinding disc. This permits the bottom of the plunge-cut groove to be directly subjected to the required surface finish treatment, regardless of whether the sawtooth wire had already been hardened prior to being wound onto the tube.

The further proposal according to which the tube with the sawtooth wire wound thereon is separated into individual card roller rings by means of a laser cutting beam offers the advantage that the card roller rings do not require any subsequent finishing treatment. The laser cutting beam cuts through the foot portions of the sawtooth wire previously welded to the tube within the plunge-out groove and through the tube itself in a single operation.

According to another advantageous provision, the laser cutting beam is guided accurately along the center of each plunge-cut groove. This results in the formation of identical clamping portions at both ends of the card roller rings.

Particular advantages are obtained by a still further characteristic of the invention, according to which the sawtooth wire is wound onto the tube in such a manner that the foot portions of adjacent sawtooth wire windings abut one another. Since the resistance against bending of the sawtooth wire necessarily varies along the length of the wire, the foot portion of the sawtooth wire clings to the tube in a polygonal configuration as the wire is being wound onto the tube. At locations between adjacent teeth the foot portion of the sawtooth wire is thus not supported on the surface of the tube. If these locations were freely accessible, it would be possible for particularly fine, thin fibres to get caught thereat, which would result in the operation of the card roller being impaired. If on the other hand the foot portions of adjacent sawtooth wire windings abut one another, the fibres are prevented from penetrating to these locations, so that they cannot get caught under the foot portion of the sawtooth wire.

Figure 2:
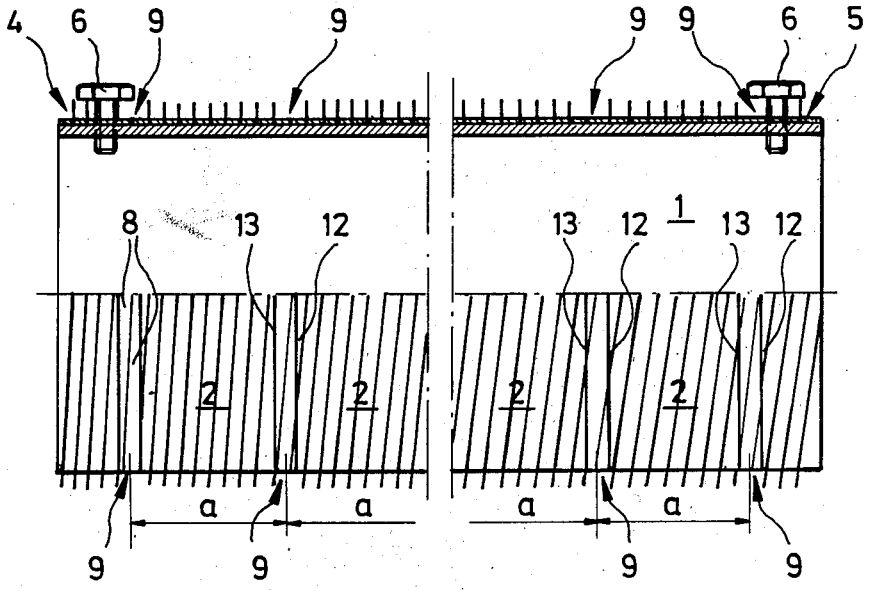
Figure 3:
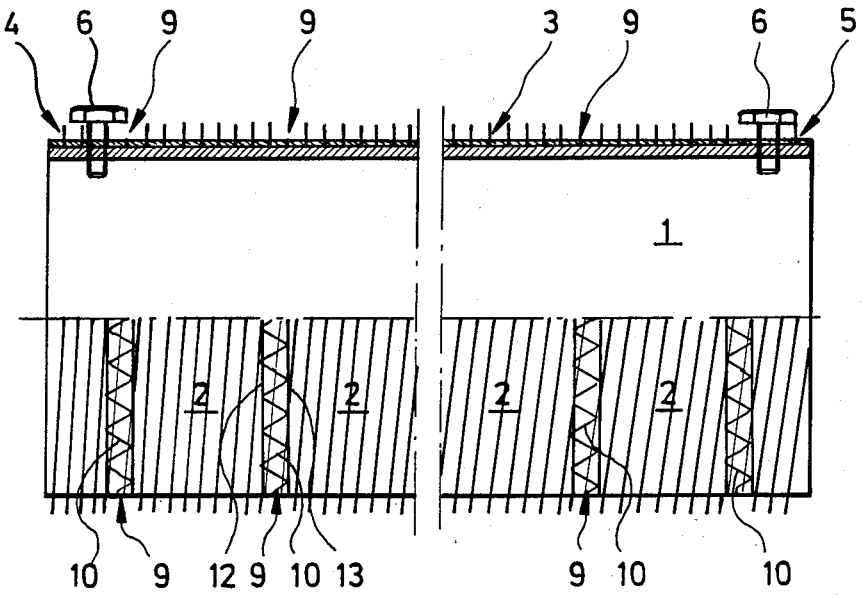
Figure 4:
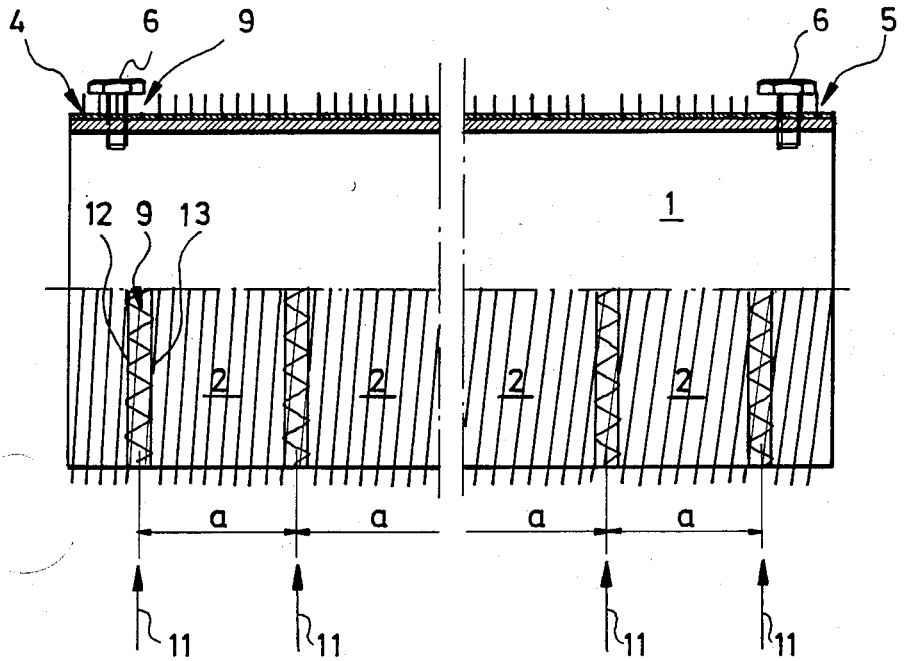
Figure 5:
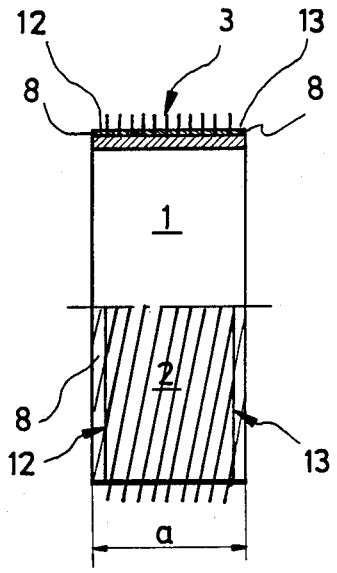
Figure 6:
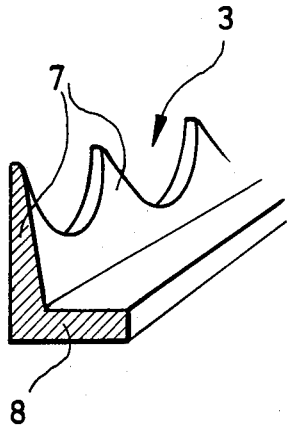

An embodiment of the invention shall now be described in detail by way of example with reference to the accompanying drawings, wherein:

FIG. 1 shows a partially sectioned sideview of a tube having a sawtooth wire wound thereon, FIG. 2 shows the tube of FIG. 1 after a further processing step, namely, the formation of plunge-cut grooves, FIG. 3 shows the tube of FIG. 1 after the securing of the sawtooth wire windings in the plunge-cut grooves, FIG. 4 shows the tube of FIG. 1 prior to being separated into individual card roller rings, FIG. 5 shows a separate card roller ring, and FIG. 6 shows a perspective sectional view of a sawtooth wire of the type wound onto the tube of FIG. 1.

Shown in FIG. 1 is a tube 1 in a partially sectioned elevational view. The length of tube 1 is a multiple of the length of the card roller rings 2 to be made (cf. FIG. 5).

Wound onto tube 1 is a sawtooth wire 3, with its leading and trailing ends 4 and 5 secured to tube 1 by means of screws 6.

A sawtooth wire 3 of this type is depicted in FIG. 6. As evident from this figure, sawtooth wire 3 is of L-shaped cross-sectional configuration, the vertical leg of the L-shape representing teeth 7, while its horizontal leg forms the foot portion 8 of sawtooth wire 3. From the illustration of FIG. 6 it is clearly recognizable that the width of foot portion 8 is a multiple of the transverse dimension of teeth 7.

Sawtooth wire 3 is wound onto tube 1 in such a manner that the foot portions 8 of adjacent sawtooth wire windings abut one another without a gap therebetween.

After the winding of sawtooth wire 3, tube 1 presents the aspect as shown in FIG. 1.

Subsequently a plunge-cut grinding disc (not shown) is used to grind away teeth 7 of sawtooth wire 3 so as to form circumferential plunge-cut grooves 9 at mutual spacings a. The only portion of sawtooth wire 3 remaining within plunge-cut grooves 9 is the respective foot portion 8.

In the embodiment shown, the width of plunge-cut grooves 9 corresponds to about one-and-a-half times that of foot portion 8 of sawtooth wire 3. A first plunge-cut groove 9 is formed immediately adjacent one of the securing screws 6, with further plunge-cut grooves 9 following at mutual spacings a corresponding to the final width of an individual card roller ring 2.

In the step of the method shown in FIG. 3, foot portion 8 of sawtooth wire 3 is secured to tube 1 within plunge-cut grooves 9 by an electron-beam welding operation. During this operation the electron-beam is guided along a zig-zag line 10 so as to act on the foot portions 8 of two adjacent sawtooth wire windings 12 and 13.

Subsequently the tube 1 with the sawtooth wire 3 wound thereon may be as a whole subjected to a plasma-coating treatment in a per se known operation. Preferred is the formation of an extremely fine-grained plasma coating, followed by a light impregnation.

This processing step is followed by the separation of tube 1 into individual card roller rings 2. This separation of tube 1 into individual card roller ings 2 is carried out by means of a laser beam 11 acting to cut through plunge-cut grooves 9 along the centerlines thereof. The separating operation results in a card roller ring 2 as individually depicted in FIG. 5. This card roller ing is ready for use without requiring ayn finishing treatment.

When determining the spacings a it has to be taken into account that a certain amount of material is lost when the card roller rings are separated by means of a laser beam, so that the spacing a has to be slightly greater than the desired final length of a card roller ring.

Although not specifically mentioned, teeth 7 of sawtooth wire 3 are advantageously hardened prior to sawtooth wire 3 being wound onto tube 1.

On the finished card roller ring 2, the leading end winding 12 and the trailing end winding 13 of sawtooth wire 3 are without teeth 7 and formed only of foot portions 8 secured to the body of tube 1 by the electron-beam welding operation.

Rather than by an electron-beam welding operation, the sawtooth wire may be also secured by a laser beam welding operation. It is also conceivable to secure the sawtooth wire to tube 1 within the plunge-cut groove by electric point welding, although this would require the provision of a countersupport within the tube. The separation of the card roller rings 2 from tube 1 may also be accomplished by mechanical means, for instance by means of a cutting disc or the like.

I claim:

1. A method for making card roller rings, particularly for open-end spinning machines, wherein a sawtooth wire comprising a sawtooth portion extending normal to a foot portion is wound onto the ring over the length thereof and the leading and trailing ends of the sawtooth wire are secured to said ring, comprising winding said sawtooth wire (3) onto a tube (1) of multiple ring length (a) with said foot portion engaging the outer surface of said tube and said sawtooth portion extending outwardly therefrom, removing said teeth (7) of said sawtooth wire (3) in a circumferential plunge-cut groove (9) extending down to said foot portion (8) of said sawtooth wire (3) at spacings substantially corresponding to the ring length (a), securing said foot portion of said sawtooth wire windings (12, 13) within said plunge-cut grooves to said tube (1), and subsequently separating said tube (1) with said sawtooth wire wound thereon into individual card roller rings (2) substantially at the center of said plunge-cut grooves (9).

2. A method according to claim 1, characterized in that prior to the separation into individual card roller rings (2) said tube (1) with said sawtooth wire (3) wound thereon is subjected to a plasma-coating treatment.

3. A method according to claim 1, characterized in that said sawtooth wire (3) is secured to said tube (1) within said plunge-cut grooves (9) by an electron-beam welding operation.

4. A method according to claim 3, characterized in that the electron-beam is guided about said tube (1) in a zig-zag pattern on the bottom of said plunge-cut groove (9).

5. A method according to claim 1, characterized in that said teeth (7) within said plunge-cut groove (9) are ground down by means of a plunge-cut grinding disc.

6. A method according to claim 1, characterized in that said tube (1) with said sawtooth wire (3) wound thereon is separated into said card rolller rings (2) by means of a laser cutting beam.

7. A method according to claim 1, characterized in that said laser cutting beam (11) is guided accurately along the center of said plunge-cut groove (9).

8. A method according to claim 1, characterized in that said saw-tooth wire (3) comprises a foot portion (8) having a greater width than said teeth (7) and is wound onto said tube (1) in such a manner that the foot portions (8) of adjacent sawtooth wire windings abut one another.

* * * * *